US008221058B2

(12) United States Patent
Fleischer et al.

(10) Patent No.: US 8,221,058 B2
(45) Date of Patent: Jul. 17, 2012

(54) FRESH GAS SYSTEM SWIRL GENERATOR

(75) Inventors: Tristan Fleischer, Northampton (GB); Neil Fraser, Northampton (GB)

(73) Assignee: Mahle International GmbH (DE)

( * ) Notice: Subject to any disclaimer, the term of this patent is extended or adjusted under 35 U.S.C. 154(b) by 663 days.

(21) Appl. No.: 12/301,569

(22) PCT Filed: May 18, 2007

(86) PCT No.: PCT/EP2007/054819

§ 371 (c)(1),
(2), (4) Date: May 19, 2009

(87) PCT Pub. No.: WO2007/135089

PCT Pub. Date: Nov. 29, 2007

(65) Prior Publication Data

US 2009/0324392 A1 Dec. 31, 2009

(30) Foreign Application Priority Data

May 19, 2006 (DE) ..... 10 2006 023 850
Dec. 7, 2006 (DE) ..... 10 2006 058 071

(51) Int. Cl.
*F01D 17/12* (2006.01)

(52) U.S. Cl. ..... 415/150; 415/147; 415/151; 415/159; 415/167

(58) Field of Classification Search ..... 415/147, 415/150, 160, 191, 151, 159, 167
See application file for complete search history.

(56) References Cited

U.S. PATENT DOCUMENTS

| | | | | |
|---|---|---|---|---|
| 3,723,021 | A | 3/1973 | Bartholomew | |
| 4,375,939 | A * | 3/1983 | Mount et al. | 415/157 |
| 6,994,518 | B2 * | 2/2006 | Simon et al. | 415/147 |

FOREIGN PATENT DOCUMENTS

| | | | |
|---|---|---|---|
| DE | 2060271 | * | 6/1972 |
| DE | 3817839 | | 12/1989 |
| DE | 102005019896 | | 11/2006 |
| EP | 1433958 | | 6/2004 |
| FR | 2878912 | * | 6/2006 |

OTHER PUBLICATIONS

English abstract for FR-2878912.
English abstract for EP-1433958.
English abstract for DE-102005019896.
English abstract for DE-3817839.

* cited by examiner

*Primary Examiner* — Steven Loke
*Assistant Examiner* — Victoria Hall
(74) *Attorney, Agent, or Firm* — Rader, Fishman & Grauer PLLC

(57) ABSTRACT

The present invention relates to a fresh gas system (1) for supplying an internal combustion engine (4) with fresh gas, in particular in a motor vehicle, having a charging device (8) for increasing the pressure of the fresh gas and having a swirl generator (12), which is arranged upstream of the charging device (8), for generating a swirl, which rotates about the main flow direction of the fresh gas, in the fresh gas, wherein the swirl generator (12) has guide blades (14) with adjustable angle of incidence. In order to be able to produce the fresh gas system (4) more cost-effectively, the swirl generator (12) has a flow guide body (13) on which the guide blades (14) are integrally formed and which, in order to adjust the angle of incidence of the guide blades (14), can be twisted with elastic deformation about the main flow direction starting from an undeformed initial position.

18 Claims, 3 Drawing Sheets

FRESH GAS SYSTEM SWIRL GENERATOR

CROSS-REFERENCES TO RELATED APPLICATION

Figure 1:
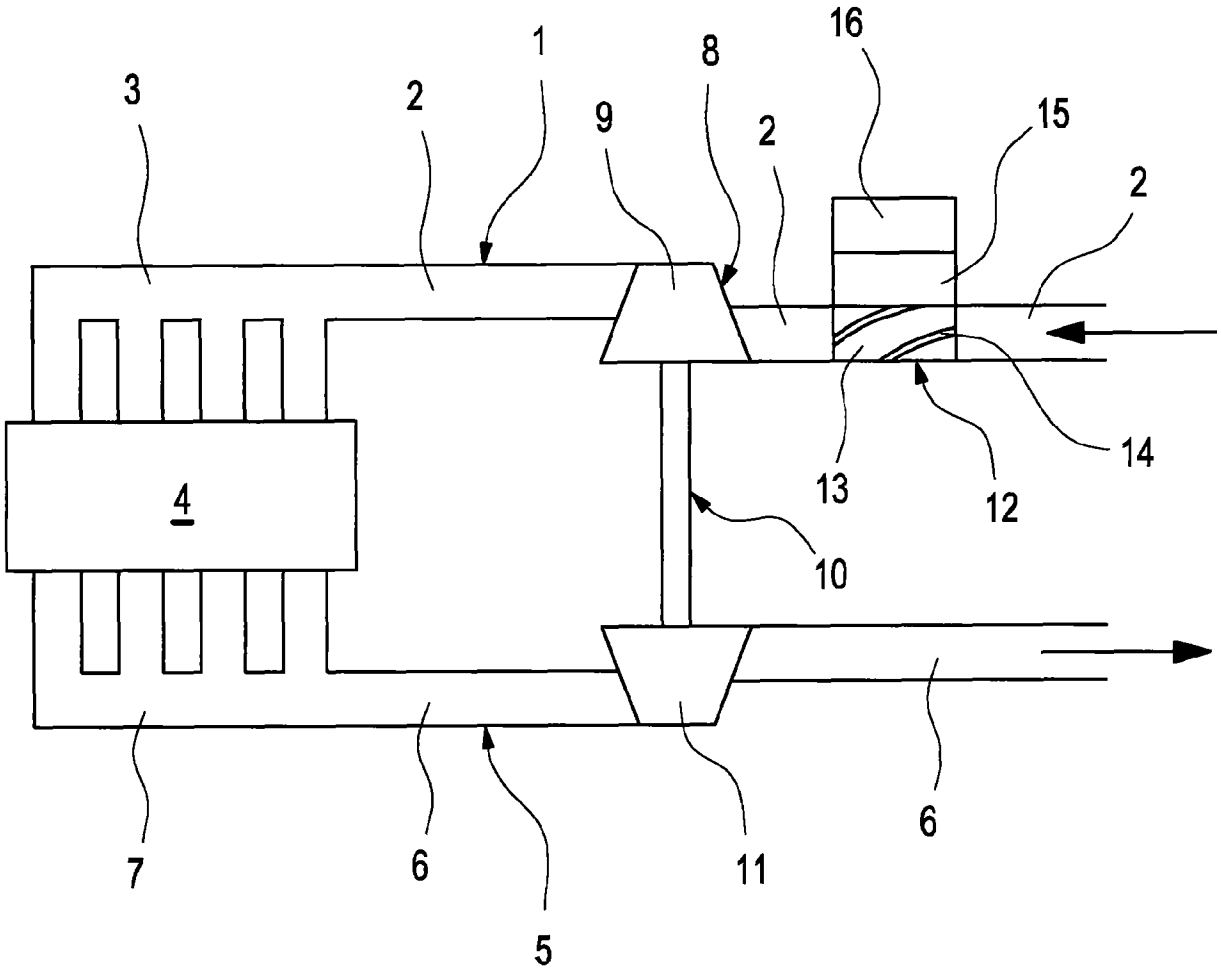

This application is a National Stage application which claims the benefit of International Application No. PCT/EP2007/054819 filed May 18, 2007, which claims priority based on German Patent Application Nos. DE 10 2006 023 850.8, filed May 19, 2006, and DE 10 2006 058 071.0, filed on Dec. 7, 2006, all of which are hereby incorporated by reference in their entirety.

The present invention relates to a fresh gas system for supplying an internal combustion engine with fresh gas, in particular in a motor vehicle, comprising the features of the preamble of claim 1. The invention relates in addition to a swirl generator for the use in such a fresh gas system.

Fresh gas systems can be provided with a charging device for pressure increase of the fresh gas, and in particular with a compressor of an exhaust gas turbocharger. It is found that it is advantageous for an increase of the performance of the charging device to expose the fresh gas flow to a swirl upstream of the charging device. Accordingly, modern fresh gas systems can comprise a swirl generator arranged upstream of the charging device.

From U.S. Pat. No. 6,994,518 B2, a charging device for increasing the pressure of the fresh gas is known which comprises a swirl generator on the inlet side, by means of which a swirl rotating about the main flow direction of the fresh gas can be generated in the fresh gas. To be able to vary the swirl in the fresh gas, the swirl generator is designed such that the guide blades are adjustable with respect to their angle of incidence. This adjustment of the guide blade of the known swirl generator is achieved in that the guide blades are attached on a stationary core radially inside on the incident flow side, are freely movable radially inside on the exhaust flow side with respect to the core, are attached radially outside on a stationary housing on the incident flow side, and are attached radially outside on a ring rotatable relative to the housing on the exhaust flow side, and that the guide blades are made of a relatively thin, elastically deformable sheet metal material. By rotating the ring, the guide blades change their angle of incidence.

The present invention is concerned with the problem to provide for a fresh gas system of the type mentioned above or for a swirl generator, respectively, an improved embodiment which is in particular characterized by a cost effective realizability.

This problem is solved according to the invention by means of the subject matters of the independent claims. Advantageous embodiments are subject matter of the dependent claims.

The invention is based on the general idea to equip the swirl generator with a flow guide body on which the guide blades are integrally formed and which can be twisted elastically about a main flow direction to thereby adjust the desired angle of incidence for the guide blades. By means of the twisting or torsion of the flow guide body, a relative movement within the flow guide body for the adjustment of the angle of incidence can be abandoned to a great extent, which makes the support of the guide blades considerably easier. Such a twistable flow guide body with integrated guide blades thus can be fabricated very cost-effectively, and accordingly, the swirl generator equipped therewith can be realized cost effectively as well. Here, the flow guide body is principally twistable in the one or the other direction so that principally positive as well as negative angles of incidence can be adjusted for the guide blades.

In a passively operating embodiment, the flow guide body can be shaped such that its guide blades, in the undeformed initial position, have a predetermined maximum angle of incidence. Furthermore, the flow guide body can then be designed such that the flow forces acting thereon during the operation, with increasing flow velocity or with increasing mass flow, respectively, cause a twisting of the flow guide body towards decreasing angles of incidence.

Alternatively, in an active embodiment, the swirl generator can be equipped with an actuator drive by means of which a desired twisting of the flow guide body can be adjusted. Hereby it is in particular possible to adjust the angle of incidence between 0°, which is the case for a parallel alignment of the guide blades to the main flow direction of the fresh gas, and a maximum angle of incidence in the one or the other direction to generate in this manner a maximum swirl in either the one or the other direction.

Further important features and advantages of the invention are apparent from the sub-claims, the drawings and the associated description of the figures by means of the drawings.

It is to be understood that the above mentioned and the following features still to be described are not only usable in the respective mentioned combination but also in other combinations or on its own without departing from the scope of the present invention.

Preferred exemplary embodiments of the invention are illustrated in the drawings and are explained in more detail in the following description, wherein identical reference numbers are related to identical, or similar, or functionally identical components.

In the figures

Figure 2:
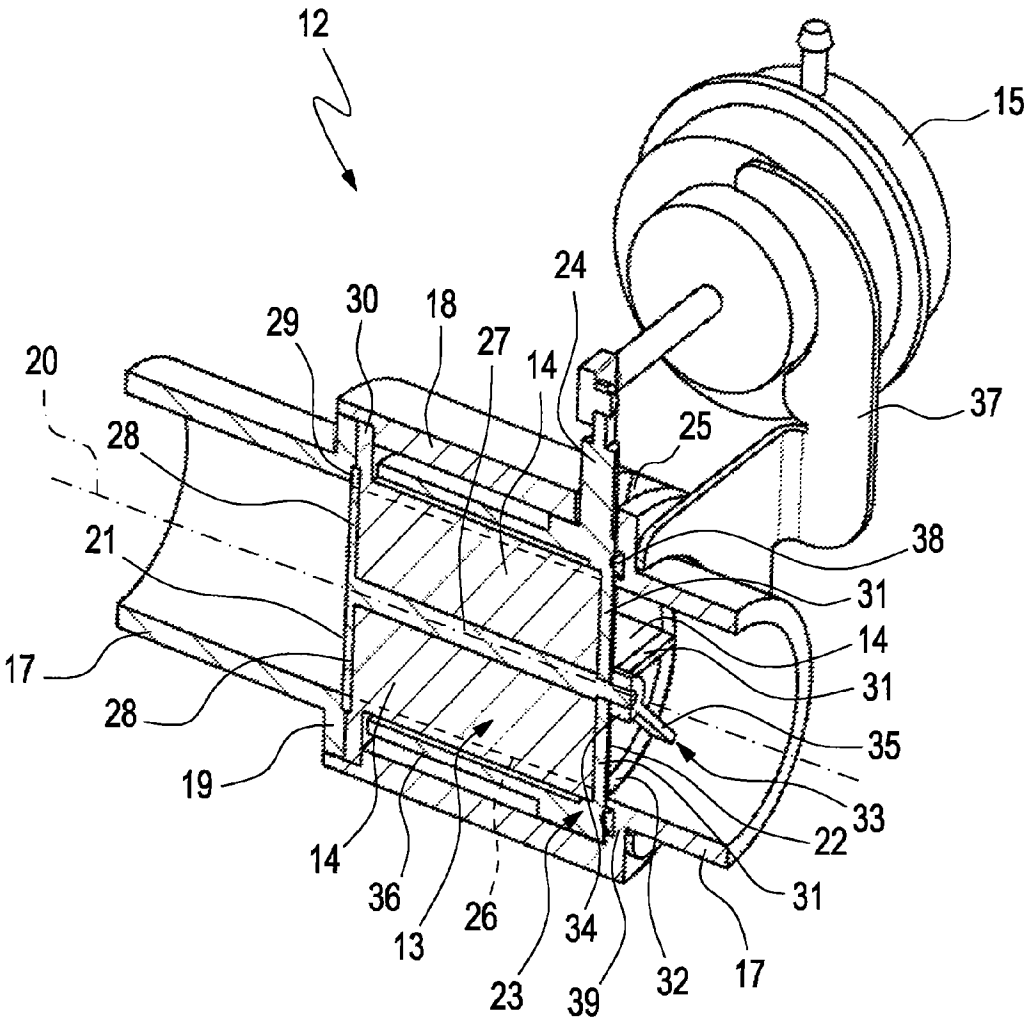
Figure 4:
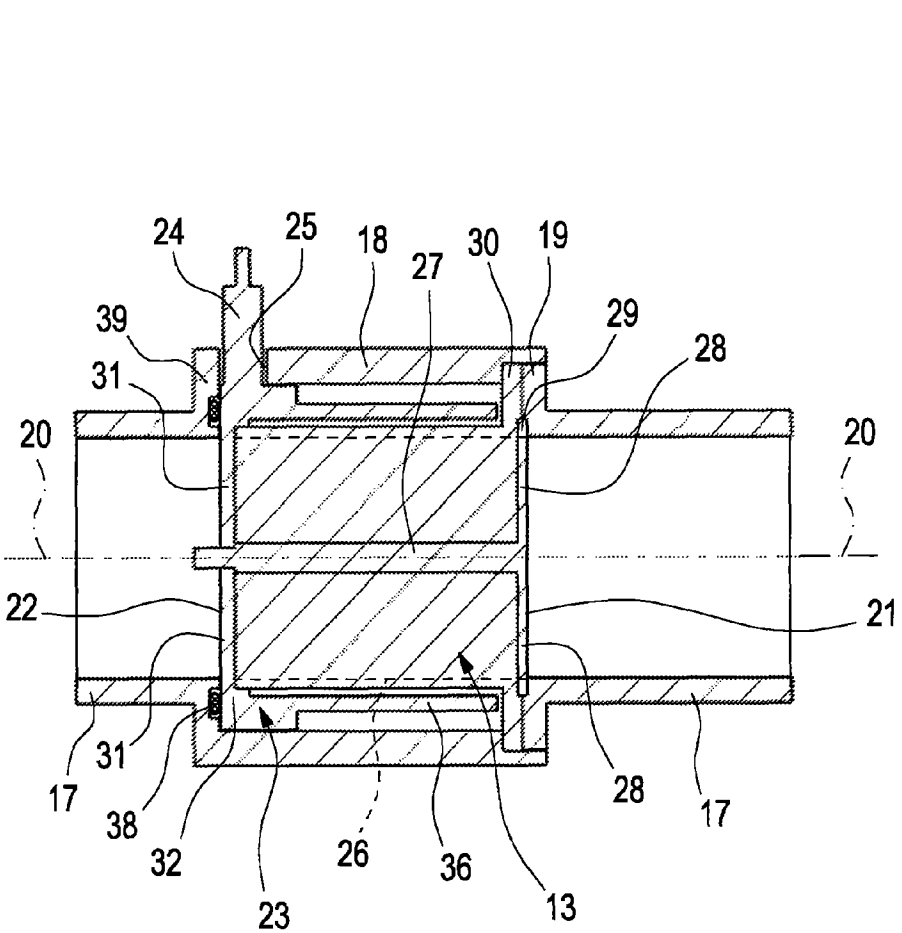
Figure 3:
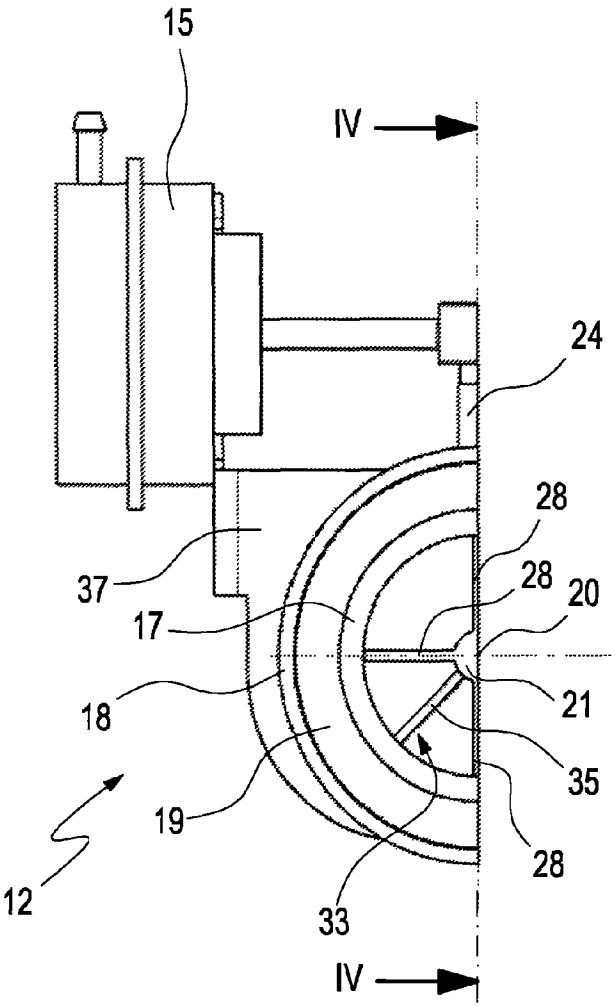

FIG. 1 shows schematically a greatly simplified, diagram-type principle illustration of an internal combustion engine comprising a fresh gas system, FIG. 2 shows a perspective view of a swirl generator in a longitudinal section FIG. 3 shows schematically a half of an axial view of the swirl generator of FIG. 2, FIG. 4 shows schematically a longitudinal section of the swirl generator corresponding to the section line IV in FIG. 3.

According to FIG. 1, a fresh gas system 1 comprises a fresh gas line 2 which is connectable to an internal combustion engine 4 via a fresh gas distributor 3. The fresh gas system 1 serves for supplying an internal combustion engine 4 with fresh gas which is in particular air. The internal combustion engine 4, as well as the fresh gas system 1 is preferably arranged in a motor vehicle. In the illustrated assembled condition, the internal combustion engine 4 comprises an exhaust gas system 5, the exhaust gas line 6 of which discharges exhaust gas via an exhaust gas collector 7 from the internal combustion engine 4. For performance increase of the internal combustion engine 4, the fresh gas system 1 can be equipped with a charging device 8 which allows a pressure increase of the fresh gas. The charging device 8 is preferably a compressor 9 of an exhaust gas turbocharger 10, the turbine 11 of which is arranged in the exhaust gas system 5. In addition, upstream of the charging device 8, the fresh gas system 1 is equipped with a swirl generator 12 which is formed such that the fresh gas supplied to the charging device 8 can be impacted by a swirl rotating about the main flow direction of the fresh gas. The swirl generator 12 has a flow guide body 13 comprising guide blades 14. In a preferred embodiment, the swirl generator 12 can be provided in addition with an actuator drive 15 and a control 16.

According to FIG. 2, the swirl generator 12 comprises a fresh gas channel 17 which can be formed by a section of the fresh gas line 2. Furthermore, the swirl generator 12 comprises a jacket-shaped housing 18 which, on the one end, merges integrally in a section of the fresh gas channel 17, and which, on the other end, is closed-off by a circular flange section 19 which is integrally formed on another section of the fresh gas channel 17, and projects therefrom collar-like outwards. By means of the integration of the housing 18 in the fresh gas channel 17, the housing 18 forms also a portion of the fresh gas channel 17. Inside the housing 18, the flow guide body 13 is arranged which exemplary comprises four guide blades 14 in the present case. There, the guide blades 14 are formed by walls which extend in axial direction and which separate channels from each other through which a flow can pass in circumferential direction. The actuator drive 15 is mounted at the fresh gas channel 17 or the housing 18, respectively, by means of an adequate shaped fitting element 37.

The guide blades 14 are arranged here star-shaped, and distributed preferably symmetrically with respect to a longitudinal center axis 20 of the swirl generator 12. Accordingly, the individual guide blades 14 are each arranged offset by 90° to each other. The guide blades 14 are formed integrally on the flow guide body 13. For example, the flow guide body 13 with the guide blades 14 is manufactured as a plastic injection molding part. Hereby, a one-injection technique can be used. It is also possible to use a two-injection technique by means of which, for example, the guide blades 14 are injection-molded onto different parts of the flow guide body 13 which are manufactured in advance. This two-injection technique will be addressed again below.

The flow guide body 13, like the guide blades 14 formed thereon, is made from an elastic material such that it is possible to twist the flow guide body 13 together with the guide blades 14 about the main flow direction or the longitudinal center axis 20, respectively. This twisting, if it takes place within a predetermined angle range, results exclusively in elastic deformations of the fluid guide body 13 or the guide blades 14, respectively. Since plastic deformations are avoided, the deformation achieved by the twisting is reversible and virtually repeatable at will. By the twisting of the flow guide body 13, the angle of incidence of the guide blades 14 changes with respect to the fresh gas flow. Consequently, depending on the twisting, thus depending on the angle of incidence, the direction and the strength of the swirl impact on the fresh gas flow can be adjusted.

In each of the FIGS. 2 to 4, for a preferred embodiment, an undeformed initial position of the flow guide body 13 is illustrated in which each of the guide blades 14 extend respectively in parallel to the main flow direction. The angle of incidence of the guide blades 14 has virtually a value here of 0°. The swirl generator 12 is deactivated in this initial position, i.e., the fresh gas flow flowing through the swirl generator 12 is not impacted by a swirl. When now the flow guide body 13 in this initial position is twisted about the longitudinal center axis 20, the guide blades 14 form helical channels between themselves which cause a swirl impact if there is a flow through the swirl generator 12. Due to the twisting of the flow guide body 13, the guide blades 14 have a more or less large angle of incidence, which can be positive or negative depending on the direction of rotation of the twisting.

Deviating from the embodiments shown here, another embodiment is principally possible in which the flow guide body 13 is fabricated such that its guide blades 14 already in the undeformed initial position show a predetermined maximum angle of incidence. This means, already in the initial position, the guide blades 14 form helical channels. The flow guide body 13 preformed in this manner is then arranged in the fresh gas channel 17 such that its incident flow end is axially fixed and torque-proofed connected with the fresh gas channel 17, while the flow guide body 13 is arranged rotatable relative to the fresh gas channel 17 about the main flow direction. The design of this preformed flow guide body 13 is preferably carried out such that by means of the occurring flow forces, e.g. dynamic pressure, the flow guide body 13 gets increasingly untwisted, and the angle of incidence of the guide blades 14 thereby is reduced automatically with increasing flow velocity of the fresh gas. In this embodiment, the swirl generator 12 operates without additional actuator drive 15, and hence passive.

However, preferred here is the embodiment shown in the FIGS. 2 to 4, in which the swirl generator 12 operates actively, hence with the actuator drive 15, to adjust the respectively desired angle of incidence for the guide blades 14. By means of the active swirl generator 12, it is in particular possible to generate a positive swirl as well as a negative swirl.

According to the FIGS. 2 to 4, the flow guide body 13 has two axial ends 21 and 22 with regard to the longitudinal center axis 20, which, depending on the flow direction of the fresh gas, form an incident flow end and an exhaust flow end. For example, the first axial end 21 forms the incident flow end, while the second axial end 22 forms the exhaust flow end. With reversed flow direction in the fresh gas, the first axial end 21 is then the exhaust flow end, while then the second axial end 22 forms the incident flow end. In the embodiment of FIGS. 2 to 4, the flow guide body 13 is axially fixed and torque-proofed connected on its first axial end 21 with the fresh gas channel 17, while it is fixed and torque-proofed connected on its second axial end 22 with a circular drive body 23. Said drive body 23 is a part of the swirl generator 12. Moreover, the drive body 23 is arranged in the fresh gas 17 rotatable about the main flow direction, hence about the longitudinal center axis 20, and can be rotatably driven by means of the actuator drive 15. The drive body 23 is supported rotatable and sealed at an annular step 39 of the housing 18 or the fresh gas channel 17, respectively, by means of an axially functioning circular seal 38, e.g. an O-ring.

For driving the drive body 23, the actuator drive 15 interacts with a drive element 24. The actuator drive 15, for example, is designed as a pneumatically operatable linear drive. The drive element 24 penetrates radially a recess 25, formed in the fresh gas channel 17 or the housing 18, respectively, and is fixed connected with the drive body 23. The drive element 24 is preferably formed integral on the drive body 23. Hereby, the linear adjustment of the actuator drive 15 can be transformed into a rotational adjustment of the drive body 23.

The flow guide body 13 can comprise a jacket-like shell 26 which extends from the first axial end 21 to the second axial end 22, and which runs in circumferential direction around the whole circumference. Preferably, said shell 26 is formed integral with the guide blades 14. In the embodiment shown here, the flow guide body 13 is fabricated such that the guide blades 14, in the shown undeformed initial position of the flow guide body 13, extend in parallel to the main flow direction of the fresh gas. Starting from this initial position, the flow guide body 13 hence can be twisted in the one and in the other rotational direction. Accordingly, the swirl generator 12 is preferably formed in a manner that, by means of the actuator drive 15, the flow guide body 13 can be twisted from the initial position in the one as well as in the other rotational direction.

The preferred embodiment of the swirl generator 12 shown here is characterized in addition by a supporting shaft 27 which is arranged coaxial to the main flow direction, and central, hence coaxial, to the longitudinal center axis 20. The supporting shaft 27 is supported axial and torque-proofed on one end at the fresh gas channel 17. On the other end, the drive body 23 is arranged at the supporting shaft 27. Moreover, the guide blades 14 are connected radially inside with the supporting shaft 27. In the shown example, the supporting shaft 27 is supported axial and torque proofed by a plurality of supporting webs 28, arranged starlike at the fresh gas channel 17. The number of supporting webs 28 corresponds to the number of guide blades 14. In the present case, thus, four supporting webs 28 are provided which are arranged offset to each other always by 90°. The supporting webs 28 are preferably formed integral on the supporting shaft 27. The individual supporting webs 28 can be connected with each other radially outside by a supporting ring 29 which extends in circumferential direction. By means of this supporting ring 29, the supporting webs 28 are supported axial and torque-proofed at the fresh gas channel 17. Said supporting ring 29 is preferably formed integral on the supporting webs 28 or the supporting shaft 27, respectively. The supporting webs 28 together with the supporting ring 29, form the first axial end 21 of the flow guide body 13.

Each of the individual guide blades 14 are axially connected with one of the supporting webs 28. This results in a form stabilization of the guide blades 14 in the region of the first axial end 21. Furthermore, according to the embodiment shown here, in the region of the supporting webs 28, the flow guide body 13 can comprise an annular collar 30, projecting radially outward. This annular collar 30 is connected with all guide blades 14 and preferably fabricated integral with the guide blades 14. Said annular collar 30 is connected torque-proofed and axial with the fresh gas channel 17. The annular collar 30, for example, is clamped between the flange 19 and the housing 18.

In the embodiment shown here, the drive body 23 has a plurality of drive webs 31 extending starlike from the supporting shaft 27. The number of drive webs 31 corresponds to the number of guide blades 14 so that four drive webs 31 are provided here which are arranged offset to each other by 90°, respectively. Furthermore, the drive body 23 comprises a drive ring 32 which connects the drive webs 31 radially outside with each other. The drive webs 31, together with the drive ring 32 form the second axial end 22 of the flow guide body 13. Each of the guide blades 14 are axially connected with one of the drive webs 31, respectively. This results in a form stabilization of the guide blades 14 in the region of the second axial end 22.

In the preferred embodiment shown here, the supporting shaft 27 is connected torque-proofed in the region of the second axial end 22 with the drive body 23. In the present case, for this purpose, the supporting shaft 27 is connected torque-proofed with the drive webs 31. It is principally also possible to support the drive body 23 or the drive webs 31, respectively, rotatably in the region of the second axial end 22 at the supporting shaft 27.

In the embodiment shown here, the supporting shaft 27 is supported rotatably and radially by a bearing body 33 at the fresh gas channel 17. Said bearing body 33 comprises a bearing core 34 at which, or in which, respectively, the supporting shaft 27 is supported rotatably in the region of the second axial end 22. Said bearing core 34 is supported by at least one bearing web 35 at the fresh gas channel 17. It is obvious that a plurality of bearing webs 35 can also be provided which then are arranged starlike.

Furthermore, the drive body 23 comprises, for example, a drive sleeve 36, which extends axially from the drive ring 32. The drive sleeve 36 extends in axial direction unto directly before the annular collar 30. This drive sleeve 36 forms a radial counter bearing for the shell 26 of the flow guide body 13, whereby the shell can expand with increased pressure in the fresh gas channel 17.

When the drive webs 31 are fixed connected with the supporting shaft 27, the twisting introduced via the drive body 23 in the flow guide body 13 results in a torsion of the supporting shaft 27, wherein the same acts as a torsion spring pre-loading the flow guide body 13 in its initial position. With a rotatable support of the drive webs 31 at the supporting shaft 27, the twisting introduced via the drive body 23 in the flow guide body 13 results in a rotation of the drive webs 31 relative to the supporting shaft 27, which results in an increased bending stress of the guide blades 14 in the region of the second axial end 22. Depending on the material selection of the guide blades 14, this bending stress can be absorbed elastically without problems.

Preferably, the drive webs 31 are formed integral on the drive body 23. Likewise, the drive ring 32 and/or the drive sleeve 36 can be formed integral on the drive body 23.

Preferably, the flow guide body 13 can be fabricated together with the drive body 23 in a manner that first the supporting shaft 27, together with the supporting webs 28, and the supporting ring 29 are made from a first plastic. Independently, the drive body 23 comprising the drive webs 31, drive ring 32, and drive sleeve 36 as well as drive element 24 can also be made from a plastic, wherein for both components the same plastic can be used. Subsequently, the two components are mounted together, i.e. the supporting shaft 27 is inserted into the center of the drive webs 31. In another injection mold, in which the supporting webs 28 and the drive webs 31, e.g., are oriented aligned to each other, the guide blades 14 and the annular collar 30 are injected in a further injection with a second plastic, wherein the guide blades 14 bond radially inside with the supporting shaft 27, and axially, on the one hand, with the supporting webs 28, and axially, on the other hand, with the drive webs 31.

The material used for the fabrication of the guide blades 14 is distinguished compared to the material used for the fabrication of the other components of the flow guide body 13 and for the fabrication of the drive body 23 by an increased bending flexibility.

The control 16 indicated in FIG. 1, for example, can be designed such that it adjusts the twisting of the flow guide body 13 depending on load and/or speed of the internal combustion engine 4. For example, this control 16 can adjust the twisting of the flow guide body 13 in a lower range of load and/or speed such that it causes a maximum angle of incidence of the guide blades 14 in the one rotational direction, thereby generating a maximum swirl in the one direction. For a medium range of load and/or speed, the control 16 can adjust the twisting of the flow guide body 13 such that the guide blades 14 are oriented in parallel to the main flow direction for a swirl-free fresh gas flow. This means, in the medium range of load and/or speed, the control 16 actuates the actuator drive 15 such that the flow guide body 13 can take its undeformed initial position corresponding to the FIGS. 2 to 4. In addition, the control 16 can be designed such that it adjusts the twisting of the flow guide body 13 in an upper range of load and/or speed such that it causes now a maximum angle of incidence of the guide blades 14 in the other direction, generating a swirl in the other rotational direction. The individual speed ranges for speed dependent control of the swirl generator 12 are adjusted to the capacity of the charging device 8 such that its capacity is optimized by the respectively set swirl direction, or by the deactivation of the swirl generator 12 in the medium range of load and/or speed, respectively.

It is obvious that the control 16 can also be designed such that it can adjust, depending on the load and/or the speed, a plurality of intermediate positions for the guide blades between the end positions associated to the maximum angles of incidence.

The invention claimed is:

1. A fresh gas system for supplying an internal combustion engine with a fresh gas, comprising:

a charging device for increasing the pressure of the fresh gas;

a swirl generator arranged upstream of the charging device for generating a swirl, which rotates about a main flow direction of the fresh gas, in the fresh gas;

a plurality of guide blades included with the swirl generator each guide blade having an adjustable angle of incidence, the guide blades each having a first end portion, a radial inner portion, a second end portion and a radial outer portion; and a supporting web for supporting the first end portion of each guide blade, wherein the swirl generator has a flow guide body on which the guide blades radial inner portion is connected, and the guide blades are selectively twisted as increased flow forces act thereon, such that the guide blades elastically deform about the main flow direction starting from an undeformed initial position, thereby adjusting the angle of incidence in at least one of a positive and a negative direction.

2. The fresh gas system according to claim 1 wherein the flow guide body is fabricated such that the guide blades have a predetermined maximum angle of incidence in the undeformed initial position, and that the flow guide body is arranged within a fresh gas channel, is connected at an incident end axially fixed and torque-proofed with the fresh gas channel, and, in addition, is arranged relative to the fresh gas channel rotatable about the main flow direction of the fresh gas.

3. The fresh gas system according to claim 1, wherein the flow guide body is arranged in a fresh gas channel and where the flow guide body is connected at a first end of a pair of axial ends axially fixed and torque-proofed with the fresh gas channel, and is connected at a second end of the pair of axial ends axially fixed and torque-proofed with a circular drive body of the swirl generator, and that the drive body in the fresh gas channel is arranged rotatable about the main flow direction of the fresh gas and is driven rotatably by means of an actuator drive of the swirl generator.

4. The fresh gas system according to claim 3, wherein the actuator drive interacts with a drive element which radially penetrates a recess formed in the fresh gas channel and which is fixedly connected with the drive body.

5. The fresh gas system according to claim 3 wherein the flow guide body comprises a shell which extends from an incident flow end to an exhaust flow end, and where the shell is at least one of (i) running in a circumferential direction around the whole circumference, and (ii) formed integral on the guide blades.

6. The fresh gas system according to claim 3, wherein the swirl generator is formed such that the flow guide body starting from the undeformed initial position, is selectively twisted in opposing rotational directions.

7. The fresh gas system according to claim 3, wherein the flow guide body is a supporting shaft, which is arranged centrically and coaxial to the main flow direction, and which is supported axially and torque-proofed at the first end at the fresh gas channel by the supporting webs, and at which the drive body is arranged at the second end.

8. The fresh gas channel according to claim 7, wherein the supporting webs are at least one of arranged starlike, connected radially outside to each other via a supporting ring, are formed integral on the supporting shaft, and wherein at least one of the supporting ring is formed integral on the supporting webs, each guide blade is connected axially, the flow guide body comprises an annular collar projecting outward, which is connected with all guide blades, and which is connected torque-proofed with the fresh gas channel, and the annular collar is formed integral on the guide blades.

9. The fresh gas system according to claim 7, wherein the drive body comprises drive webs, wherein at least one of the following is selected:

the drive webs are extending starlike from the supporting shaft, that the drive webs are connected to each other radially outside via a drive ring of the drive body, that each guide blade is connected axially with one of the drive webs, respectively, that one of the drive body and the drive webs are one of the following: i. connected torque-proofed with the supporting shaft and ii. supported rotatably at the supporting shaft, that the supporting shaft is supported rotatably and radially via a bearing body at the fresh gas channel, that a bearing body comprises a bearing core that is one of supported rotatably at the supporting shaft, and is supported rotatably in the supporting shaft, and at least one bearing web which supports the bearing core at the fresh gas channel and which extends radially from the bearing core, that the drive body comprises a drive sleeve which extends axially starting at the drive ring, that the drive webs are formed integral on the drive body, that the drive ring is formed integral on the drive body, and that the drive sleeve is formed integral on the drive body.

10. The fresh gas system according to claim 7, wherein that for the torque-proofed connection of the supporting shaft, the guide blades are injected at a location that is at least one of at the supporting shaft, at the supporting webs, and at the supporting ring.

11. The fresh gas system according to claim 1, wherein a control is provided which, depending on at least one of the load and speed of the internal combustion engine, adjusts the twisting of the flow guide body, wherein the control adjusts the twisting of the flow guide body in at least one of a lower range of load and speed such that the result is a maximum angle of incidence in a one direction for a swirl in a one rotational direction, wherein the control adjusts the twisting of the flow guide body in at least one of a medium range of load and speed such that the guide blades are aligned in parallel to the main flow direction of the fresh gas for a swirl-free fresh gas flow, wherein the control adjusts the twisting of the flow guide body in at least one of an upper range of load and speed such that the result is a maximum angle of incidence in another direction for a swirl in another rotational direction.

12. The fresh gas system according to claim 11, wherein the control is designed to adjust, depending on at least one of the load and speed, a plurality of intermediate positions between end positions that are associated to the maximum angles of incidence.

13. The fresh gas system according to claim 1, wherein the flow guide body is selected from at least one of the following:

the flow guide body is made of an elastic plastic based material as a single piece, and comprises guide blades integrally formed thereon, the angle of incidence of which is adjustable with respect to the main flow direction of the flow guide body by twisting the flow guide body about the main flow direction starting from undeformed initial position, and that the flow guide body manufactured by plastic injection molding by one of a one-injection molding technique, and in a two-injection molding technique.

14. The fresh gas system according to according to claim 1, wherein the swirl generator is a flow guide body on which guide blades are integrally formed, and which, for adjusting the angle of incidence of the guide blades, is twisted with elastic deformation about the main flow direction starting from the undeformed initial position.

15. The fresh gas system according to claim 4, wherein the flow guide body comprises a shell which extends from an incident flow end to an exhaust flow end, and where the shell is at least one of (i) running in a circumferential direction around the whole circumference, and (ii) formed integral on the guide blades.

16. The fresh gas system according to claim 4, wherein the swirl generator is formed such that the flow guide body, starting from the undeformed initial position, is twisted in opposing rotational directions.

17. The fresh gas system according to claim 4, wherein the flow guide body comprises a supporting shaft which is arranged centrically and coaxial to the main flow direction, and which is supported axially and torque-proofed at the first end at the fresh gas channel, and at which the drive body is arranged at the second end, and with which the guide blades are connected radially inside.

18. The fresh gas system according to claim 8, wherein the drive body comprises drive webs, wherein at least one of the following is selected:

the drive webs are extending starlike from the supporting shaft, that the drive webs are connected to each other radially outside via a drive ring of the drive body, that each guide blade is connected axially with one of the drive webs, respectively, that one of the drive body and the drive webs are one of the following: i. connected torque-proofed with the supporting shaft and ii. supported rotatably at the supporting shaft, that the supporting shaft is supported rotatably and radially via a bearing body at the fresh gas channel, that a bearing body comprises a bearing core that is one of supported rotatably at the supporting shaft, and supported rotatably in the supporting shaft, and at least one bearing web which supports the bearing core at the fresh gas channel and which extends radially from the bearing core, that the drive body comprises a drive sleeve which extends axially starting at the drive ring, that the drive webs are formed integral on the drive body, that the drive ring is formed integral on the drive body, and that the drive sleeve is formed integral on the drive body.

* * * * *